US006312346B1

(12) United States Patent
Sugimoto

(10) Patent No.: US 6,312,346 B1
(45) **Date of Patent: *Nov. 6, 2001**

(54) MULTI-PIECE SOLID GOLF BALL

(75) Inventor: Kazushige Sugimoto, Shirakawa (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/141,602

(22) Filed: Aug. 28, 1998

(30) Foreign Application Priority Data

Aug. 29, 1997 (JP) ..... 9-234273

(51) Int. Cl.[7] ..... A63B 37/08

(52) U.S. Cl. ..... 473/370

(58) Field of Search ..... 473/372, 373, 473/374, 370

(56) References Cited

U.S. PATENT DOCUMENTS 4,863,167 * 9/1989 Matsuki et al. ..... 473/374 X
4,955,613 * 9/1990 Gendreau et al. ..... 525/193
5,585,440 * 12/1996 Yamada et al. ..... 473/372 X
5,935,022 * 8/1999 Sugimoto et al. ..... 473/373

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

The present invention provides a multi-piece solid golf ball having little unevenness in physical properties. The present invention relates to a multi-piece solid golf ball comprising a center, an intermediate layer formed on the center, and a cover covering the intermediate layer, wherein the intermediate layer is composed of one or more layers mainly containing a rubber component, the rubber component for the intermediate layer has a Mooney viscosity of 25 to 40 ML(1+4)100° C.

3 Claims, 3 Drawing Sheets

MULTI-PIECE SOLID GOLF BALL

FIELD OF THE INVENTION

The present invention relates to a multi-piece solid golf ball. More particularly, it relates to a multi-piece solid golf ball having little unevenness in physical properties.

BACKGROUND OF THE INVENTION

Hitherto, golf balls are typically classified into thread wound golf balls and solid golf balls. The solid golf ball, particularly two-piece solid golf ball is generally approved or employed by most of amateur golfers, because it has better durability and better flight performance than the thread wound golf ball. It is, however, generally known that the two-piece golf ball exhibits better durability and better flight performance, but is poor in shot feel.

It has been attempted to make soft the shot feel of the two-piece solid golf ball equal to thread wound golf balls by adjusting a hardness of a core or cover. The improvement of the two-piece solid golf ball for making shot feel soft has also been conducted by making its core or cover two or more layers. The golf ball whose core or cover is made two or more layers is called as a multi-piece solid golf ball.

Among the multi-piece solid golf balls, a three-piece solid golf ball having two-layered core or two-layered cover has been mostly developed. In the three-piece solid golf ball, a two-layered core-type three-piece golf ball, of which the core is made two-layered, has been usefully employed. One embodiment of the method of producing the two-layered core-type three-piece golf ball will be explained.

A center for the two-layered core is vulcanized or press-molded, and an intermediate layer is covered on the center and vulcanized or press-molded to obtain a two-layered core. The resulting core is covered with a cover to obtain a three-piece solid golf ball. The step of producing the two-layered core will be explained in detail. The center is obtained by mixing a rubber composition which is formulated for obtaining desired physical properties to form plugs having a proper size, putting the plugs in a mold, and vulcanizing or press-molding the rubber composition in a spherical shape. The intermediate layer is obtained by mixing a rubber composition for the intermediate layer to form plugs, putting the plugs in two molds having a semi-spherical cavity, pressing the rubber composition using a male plug mold to form a semi-spherical concave, inserting the center in one concave, putting the other concave on it to cover on the center, and vulcanizing or press-molding it to form a two-layered core.

In the step of covering the center with two of the rubber compositions for the intermediate layer, since the rubber compositions are unvulcanized, two of the rubber compositions are adhered with each other for a while. However, the two rubber compositions are separated from the adhesive surface because of the shrinking characteristics of the rubber composition. When vulcanizing or press-molding the rubber composition with separation of the adhesive surface, the portions of the intermediate layer with separation of the adhesive surface and the opposite portion of the intermediate layer to the center have different thickness of the intermediate layer, and thus the center is eccentric. The eccentricity of the center gives unevenness of physical properties of the resulting golf ball, and thus it is required to restrain the eccentricity as low as possible.

OBJECTS OF THE INVENTION

A main object of the present invention is to provide a multi-piece solid golf ball having little unevenness in physical properties.

According to the present invention, the object described above has been accomplished by placing an intermediate layer mainly containing a rubber component between a core and a cover, adjusting a Mooney viscosity of the rubber component for the intermediate layer to a specified range, thereby restraining the separation of the rubber composition for the intermediate layer from the adhesive surface to restrain the eccentricity of the center, and providing a multi-piece solid golf ball having little unevenness in physical properties.

This object as well as other objects and advantages of the present invention will become apparent to those skilled in the art from the following description with reference to the accompanying drawings.

SUMMARY OF THE INVENTION

The present invention provides a multi-piece solid golf ball comprising a center, an intermediate layer formed on the center, and a cover covering the intermediate layer, wherein the intermediate layer is composed of one or more layers mainly containing a rubber component, the rubber component for the intermediate layer has a Mooney viscosity of 25 to 40 ML(1+4)100° C.

DETAILED DESCRIPTION OF THE INVENTION

The term "Mooney viscosity" as used herein refers to an indication of a viscosity which is measured using a Mooney viscometer as a kind of rotational plastometer. The Mooney viscosity is typically used for measuring a viscosity of a rubber composition in the field of rubber industry. The Mooney viscosity is determined by closely putting a rubber composition in a gap between a cylindrical dice and a rotor positioned at the center of the dice, and then measuring a torque occurring when rotating a rotor at a testing temperature of 100° C., for a preheating time of 1 minute, at the number of revolutions of 2 rpm, for the time of revolution of 4 minutes. The Mooney viscosity is expressed in ML(1+4)100° C., wherein M represents a Mooney viscosity, L represents a large rotor (L type) as a shape of the rotor, (1+4) represents that a preheating time is 1 minute and a time of revolution of the rotor is 4 minutes, and 100° C. represents a testing temperature. The measurement is generally conducted according to JIS K 6300.

Figure 1:
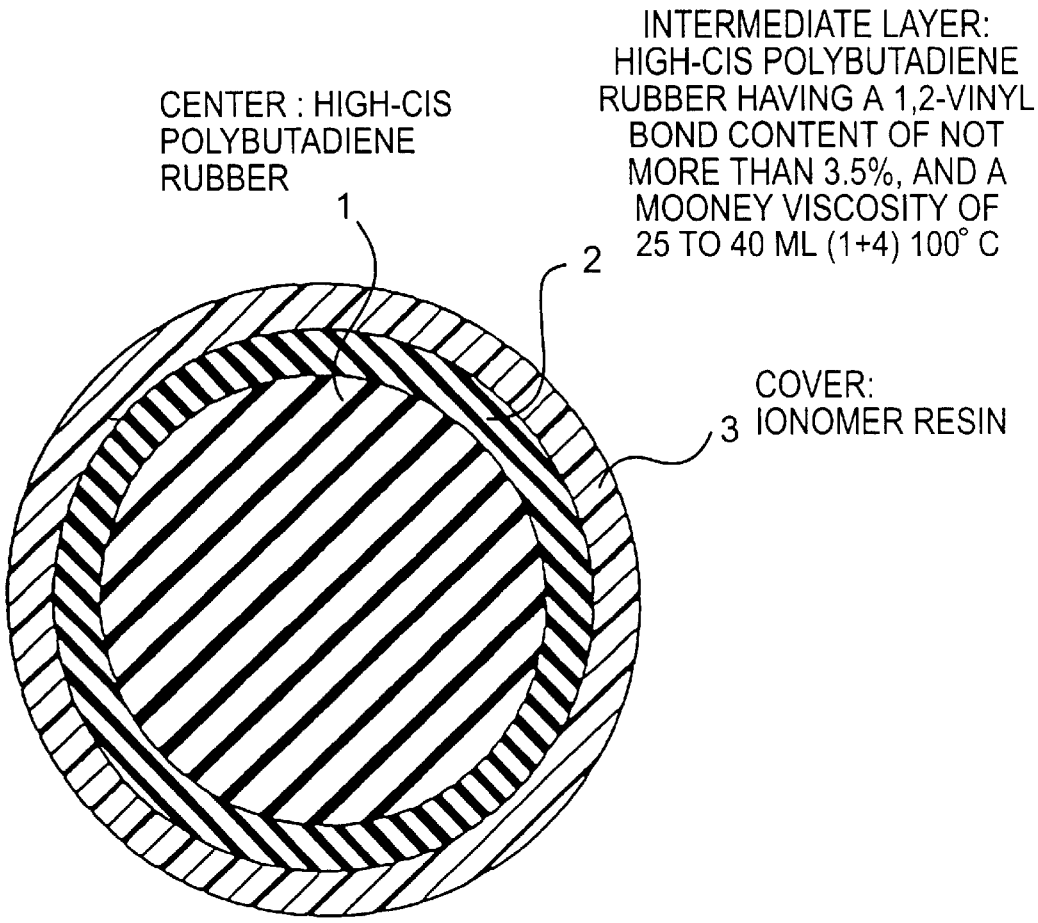
FIG. 1 is a schematic cross section illustrating one embodiment of the golf ball of the present invention.

The multi-piece solid golf ball of the present invention will be explained with reference to the accompanying drawing, for example a three-piece solid golf ball. FIG. 1 is a schematic cross section illustrating one embodiment of the multi-piece solid golf ball of the present invention. In FIG. 1, 1 is a center, 2 is an intermediate layer formed on the center and 3 is a cover covering the intermediate layer 2.

Figure 2:
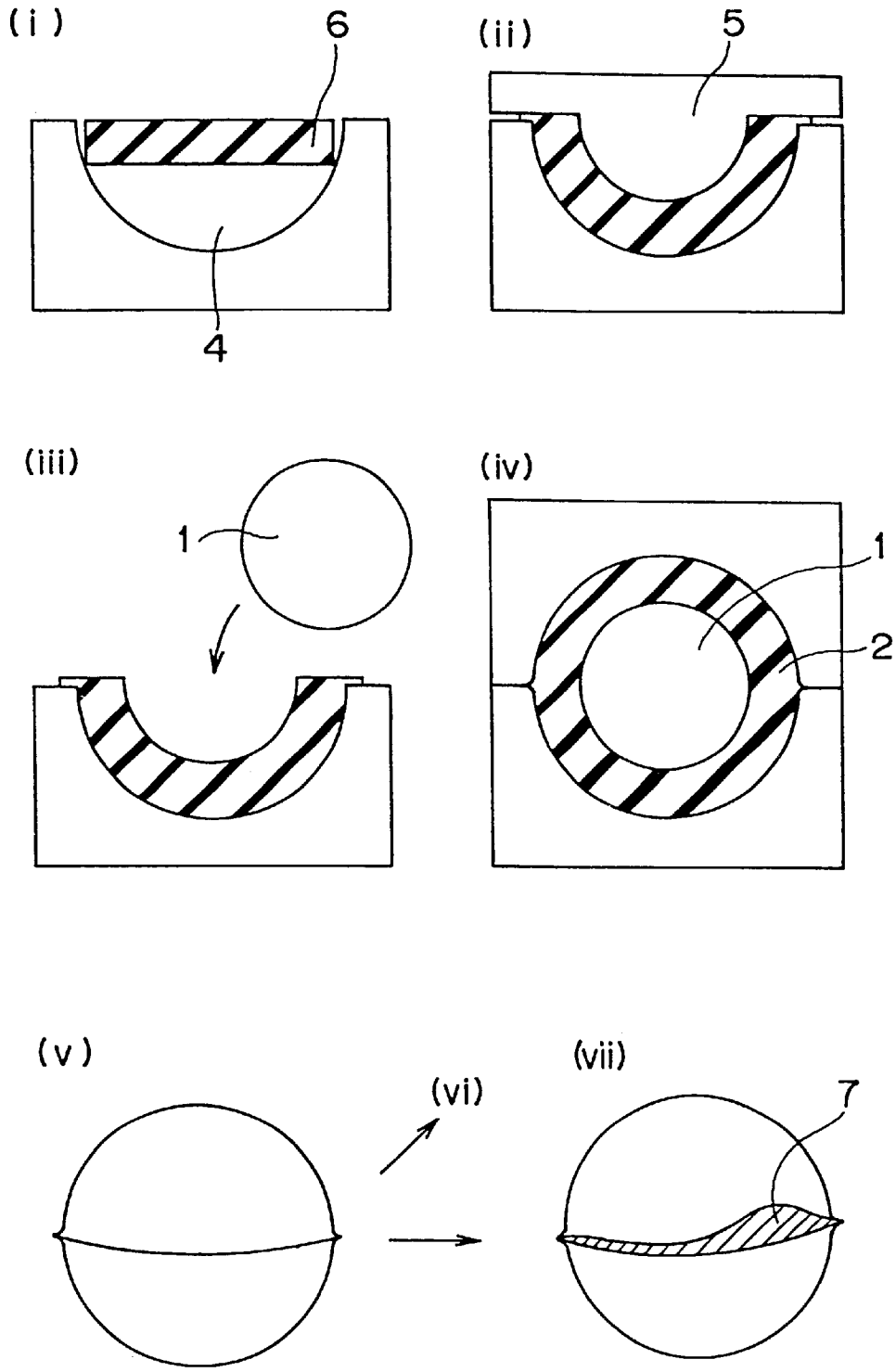
FIG. 2 is a scheme illustrating one embodiment of the process of producing the two-layered core of the golf ball of the present invention.
Figure 3:
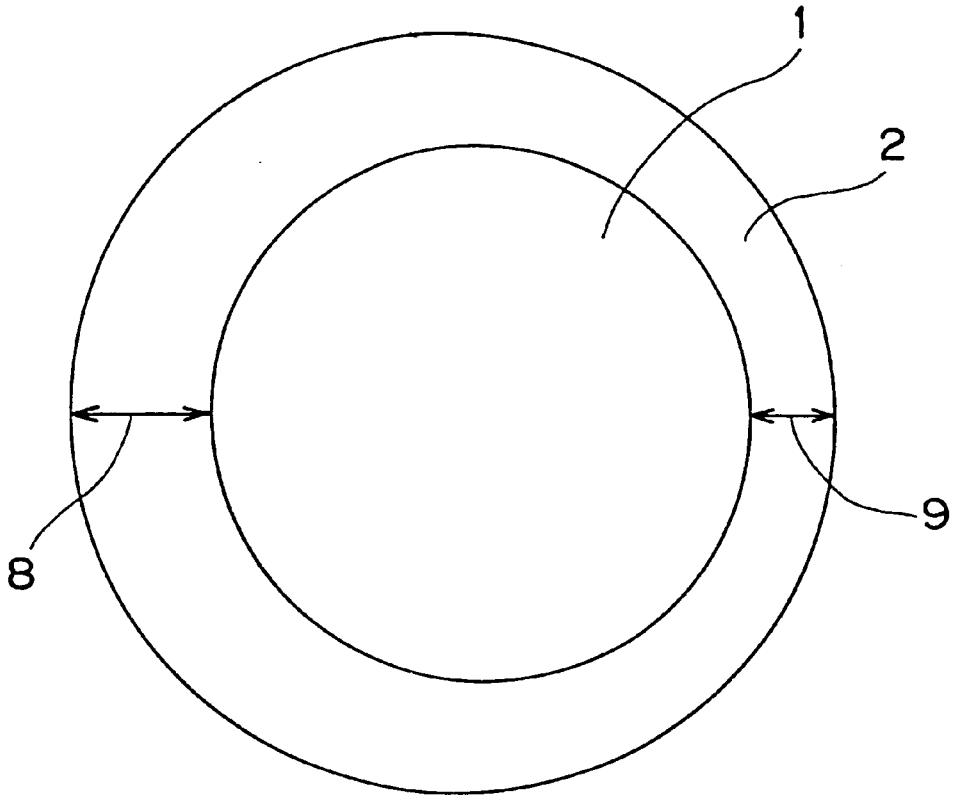
FIG. 3 is a schematic cross section illustrating the golf ball of which center is eccentric.

FIG. 2 is a scheme illustrating one embodiment of the process of producing the two-layered core of the golf ball of the present invention. In FIG. 2, the process comprises the steps of (i) introducing a rubber composition for an intermediate layer as a plug 6 in two molds having a semi-spherical cavity 4 respectively, (ii) pressing the rubber composition using a male plug mold 5 to form a semi-spherical concave, (iii) inserting the center 1 in one concave, and (iv) putting the other concave on it to cover on the center. The article in the state (v) of FIG. 2 is generally vulcanized or press-molded at the step of vulcanization (vi) to form a two-layered core. However, in the state (v), since the rubber compositions for the intermediate layer are unvulcanized when the center 1 is covered with two rubber compositions for the intermediate layer, the two rubber compositions for the intermediate layer are adhered with each other at the adhesive surface for a while. However, (vii) the two rubber compositions are separated from the adhesive surface 7 because of shrinking characteristics of the rubber composition. When vulcanizing or press-molding the rubber composition with the separation from the adhesive surface, the portion of the intermediate layer separated from the adhesive surface and the opposite portion of the intermediate layer to the center have different thickness of the intermediate layer, and thus the center is eccentric, as described in FIG. 3. The eccentricity of the center gives unevenness of physical properties of the resulting golf ball.

In the present invention, an adhesion between rubber compositions for the intermediate layer is largely improved to restrain the separation from the adhesive surface by using a rubber component having a Mooney viscosity of 25 to 40 ML(1+4)100° C. for an intermediate layer, and thus the eccentricity of the center is effectively inhibited to obtain a multi-piece solid golf ball having little unevenness in physical properties.

Both the center 1 and the intermediate layer 2 are obtained by vulcanizing or press-molding a rubber composition. The rubber composition typically comprises a base rubber, a crosslinking agent, a metal salt of an unsaturated carboxylic acid, optionally a filler and antioxidant, and the like. The center 1 is obtained by vulcanizing or press-molding the rubber composition using a method and condition which have been conventionally used for a solid center. An intermediate layer 2 is formed on the resulting center 1 by the above method. The intermediate layer 2 may have single layer structure, or multi-layer structure which has two or more layers.

The base rubber used for the center 1 of the present invention may be natural rubber and/or synthetic rubber which has been conventionally used for solid golf balls. Preferred is high-cis polybutadiene rubber containing a cis-1,4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The base rubber used for the intermediate layer 2 of the present invention is polybutadiene, preferably high-cis polybutadiene rubber containing a cis-1,4 bond of not less than 80%, most preferably polybutadiene containing a 1,2-vinyl bond of not more than 3.5% and having a Mooney viscosity of 25 to 40 ML(1+4)100° C., preferably 25 to 35 ML(1+4)100° C. When the Mooney viscosity is smaller than 25 ML(1+4)100° C., workability when mixing the rubber composition is degraded. On the other hand, when the Mooney viscosity is larger than 40 ML(1+4)100° C., an adhesion between rubber compositions for the intermediate layer is degraded to result in an eccentricity of the center. When the 1,2-vinyl bond containing in the polybutadiene is more than 3.5%, an adhesion between rubber compositions for the intermediate layer is degraded, and rebound characteristics are degraded.

The crosslinking agent includes organic peroxide, for example, dicumyl peroxide, t-butyl peroxide and the like. Preferred is dicumyl peroxide. An amount of the crosslinking agent is from 0.5 to 2.0 parts by weight in the center 1 and 1.0 to 3.0 parts by weight in the intermediate layer 2, based on 100 parts by weight of the base rubber. When the amount of the crosslinking agent is smaller than 0.5 parts by weight in the center 1 and 1.0 parts by weight in the intermediate layer 2, the center is too soft. Therefore, rebound characteristics are degraded to reduce flight distance. On the other hand, when the amount of the crosslinking agent is larger than 2.0 parts by weight in the center 1 and 3.0 parts by weight in the intermediate layer 2, the center is too hard, and thus shot feel is poor.

The metal salt of unsaturated carboxylic acid, which acts as a co-crosslinking agent, includes mono or divalent metal salts, such as zinc or magnesium salts of $\alpha,\beta$-unsaturated carboxylic acids having 3 to 8 carbon atoms (e.g. acrylic acid, methacrylic acid, etc.). Preferred co-crosslinking agent is zinc acrylate because it imparts high rebound characteristics to the resulting golf ball. An amount of the metal salt of the unsaturated carboxylic acid in the rubber composition is from 15 to 30 parts by weight, preferably from 20 to 30 parts by weight in the center 1, and from 20 to 35 parts by weight, preferably from 25 to 35 parts by weight in the intermediate layer 2, based on 100 parts by weight of the base rubber. When the amount of the metal salt of the unsaturated carboxylic acid is larger than 30 parts by weight in the center 1 and 35 parts by weight in the intermediate layer 2, the resulting golf ball is too hard, and thus shot feel is poor. On the other hand, when the amount of the metal salt of the unsaturated carboxylic acid is smaller than 15 parts by weight in the center 1 and 20 parts by weight in the intermediate layer 2, the resulting golf ball is soft. Therefore, rebound characteristics are degraded to reduce flight distance.

The filler, which can be typically used for golf ball, includes for example, inorganic filler (such as zinc oxide, barium sulfate, calcium carbonate and the like), high specific gravity metal powder filler (such as powdered tungsten, powdered molybdenum, and the like), and the mixture thereof. An amount of the filler is not limited and can vary depending on the specific gravity and size of the cover and core, but is from 3 to 35 parts by weight, preferably from 3 to 30 parts by weight, more preferably from 3 to 15 parts by weight in the center 1, and from 15 to 50 parts by weight in the intermediate layer 2, based on 100 parts by weight of the base rubber. When the amount of the filler is smaller than 3 parts by weight in the center 1 and 15 parts by weight in the intermediate layer 2, the center or the intermediate layer is too light, and thus the resulting golf ball is too light. On the other hand, when the amount of the filler is larger than 35 parts by weight in the center 1 and 50 parts by weight in the intermediate layer 2, the center or the intermediate layer is too heavy, and thus the resulting golf ball is too heavy.

The rubber composition for the center 1 and the intermediate layer 2 of the golf ball of the present invention can contain other components which have been conventionally used for preparing the core of solid golf balls, such as peptizing agent or antioxidant. If used, an amount of the antioxidant is preferably 0.2 to 1.5 parts by weight, based on 100 parts by weight of the base rubber.

In the solid golf ball of the present invention, the center has a diameter of 20 to 35 mm, preferably 25 to 35 mm. When the diameter of the center is smaller than 20 mm, a thickness of the intermediate layer is too thick, and thus shot feel of the resulting golf ball is poor. On the other hand, when the diameter of the center is larger than 35 mm, the thickness of the intermediate layer is too thin, and thus technical effects accomplished by the presence of the intermediate layer are not obtained. The two-layered core produced by forming the intermediate layer on the center preferably has a diameter of 37 to 40 mm, and therefore the intermediate layer has a thickness of 1 to 10 mm, preferably 2 to 8 mm, because the center has the diameter of 20 to 35 mm as described above. When the thickness of the intermediate layer is smaller than 1 mm, an adhesion between the intermediate layers is not sufficiently obtained, and thus the intermediate layers easily separate from the adhesive surface. On the other hand, when the thickness of the intermediate layer is larger than 10 mm, the thickness of the intermediate layer is too thick, and thus shot feel is poor.

The cover 3 is then covered on the intermediate layer 2. In the golf ball of the present invention, the cover may be formed from ionomer resin or the mixture of thereof. The ionomer resin is an ethylene-(meth)acrylic acid copolymer, of which a portion of carboxylic acid groups is neutralized with metal ion, which has been conventionally used for preparing the cover of solid golf balls. The metal ion which neutralizes a portion of carboxylic acid groups of the copolymer includes alkali metal ion, such as sodium ion, potassium ion, lithium ion and the like; divalent metal ion, such as zinc ion, calcium ion, magnesium ion, and the like; trivalent metal ion, such as aluminum ion, neodymium ion, and the like; and the mixture thereof. Preferred are sodium ion, zinc ion, lithium ion and the like, in view of rebound characteristics, durability and the like. The ionomer resin is not limited, but examples thereof will be shown by a trade name thereof. Examples of the ionomer resin, which is commercially available from Mitsui Du Pont Polychemical Co., include Hi-milan 1557, Hi-milan 1605, Hi-milan 1652, Hi-milan 1705, Hi-milan 1706, Hi-milan 1707, Hi-milan 1855 and Hi-milan 1856. Examples of the ionomer resin, which is commercially available from Exxon Chemical Co., include Iotec 7010, Iotec 8000, and the like. These ionomer resins are used alone or in combination.

The cover used in the present invention may optionally contain pigments (such as titanium dioxide, etc.), fillers (such as barium sulfate, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover. An amount of the pigment is preferably from 0.1 to 0.5 parts by weight based on 100 parts by weight of the cover resin component.

The cover used in the present invention is formed by a conventional method for forming golf ball cover well known in the art, such as injection molding, press-molding and the like. The cover preferably has a thickness of 1 to 3 mm. At the time of cover molding, many depressions called "dimples" may be optionally formed on the surface of the golf ball. Furthermore, paint finishing or marking stamp may be optionally provided after cover molding for serving commercial sell.

EXAMPLES

The following Examples and Comparative Examples further illustrate the present invention in detail but are not to be construed to limit the scope of the present invention.

Production of Center

The center rubber composition shown in Table 1 were mixed, and then vulcanized by press-molding at 150° C. for 30 minutes to obtain spherical centers having a diameter of 30 mm.

TABLE 1

| Center composition | Amount (parts by weight) |
|---|---|
| BR-18 *1 | 100 |
| Zinc acrylate | 25 |
| Zinc oxide | 21 |
| Antioxidant *5 | 0.5 |
| Dicumyl peroxide | 1.2 |

*1: High-cis-1,4-polybutadiene (trade name "BR-18") from JSR Co., Ltd.
*5: Antioxidant (trade name "Yoshinox 425") from Yoshitomi Pharmaceutical Inds., Ltd.

(Examples 1 to 3 and Comparative Examples 1 to 3)

Production of two-layered core (Formation of intermediate layer)

The intermediate layer compositions shown in Table 2 were mixed, molded to a plug 6 in the shape of coin, and then covered on the resulting center, as described in FIG. 2, and then vulcanized at 150° C. for 20 minutes to obtain the two-layered cores of Examples 1 to 3 and Comparative Examples 1 to 3 having a diameter of 38.4 mm. The numbers of occurring separation of the intermediate layer from the adhesive surface and eccentricity of the center after vulcanization were measured, and the results are shown in Table 4. The test methods are as follows. Amount of component in Table 2 is represented by parts by weight.

TABLE 2

| Intermediate layer | Example | | | Comparative Example | | |
|---|---|---|---|---|---|---|
| composition | 1 | 2 | 3 | 1 | 2 | 3 |
| BR-18 *1 | — | — | — | 100 | — | — |
| BR-11 *2 | 75 | — | 50 | — | — | 100 |
| BR-10 *3 | 25 | 100 | 50 | — | — | — |
| BR-02LL *4 | — | — | — | — | 100 | — |
| Zinc acrylate | 30 | 30 | 30 | 30 | 30 | 30 |
| Zinc oxide | 21 | 21 | 21 | 21 | 21 | 21 |
| Antioxidant *5 | 0.5 | 0.5 | 0.5 | 0.5 | 0.5 | 0.5 |
| Dicumyl peroxide | 2.0 | 2.0 | 2.0 | 2.0 | 2.0 | 2.0 |
| Mooney viscosity of the rubber component [ML (1 + 4) 100° C.] | 39 | 27 | 35 | 60 | 27 | 53 |
| Content of 1,2-vinyl bond in the rubber component (%) | 2.5 | 2.6 | 2.4 | 2.1 | 4.0 | 2.1 |

*1 to *4: Polybutadienes available from JSR Co., Ltd. having the following properties.

| Rubber component | Mooney viscosity [ML (1 + 4) 100° C.] | Content of 1,2-vinyl bond (%) |
|---|---|---|
| BR-18 *1 | 60 | 1.9 |
| BR-11 *2 | 43 | 2.1 |
| BR-10 *3 | 27.5 | 2.6 |
| BR-02LL *4 | 27.5 | 4.0 |

*5: Antioxidant (trade name "Yoshinox 425") from Yoshitomi Pharmaceutical Inds., Ltd.
*6: When using two rubber components as described in Examples 1 and 3, Mooney viscosity of the rubber component is that of the mixture of only two rubber components.

Production of golf balls (Formation of cover)

The cover compositions shown in Table 3 were covered on the resulting two-layered core by injection molding to obtain golf balls having a diameter of 42.7 mm.

TABLE 3

| Cover compositions | Amount (parts by weight) |
|---|---|
| Hi-milan 1706 *7 | 44 |
| Hi-milan 1605 *8 | 44 |
| Hi-milan 1555 *9 | 6 |
| Hi-milan 1557 *10 | 6 |
| Titanium dioxide | 4 |

*7: Hi-milan 1706 (trade name), ethylene-methacrylic acid copolymer ionomer resin obtained by neutralizing with zinc ion, manufactured by Mitsui Du Pont Polychemical Co., Ltd.
*8: Hi-milan 1605 (trade name), ethylene-methacrylic acid copolymer ionomer resin obtained by neutralizing with sodium ion, manufactured by Mitsui Du Pont Polychemical Co., Ltd.
*9: Hi-milan 1555 (trade name), ethylene-methacrylic acid copolymer ionomer resin obtained by neutralizing with sodium ion, manufactured by Mitsui Du Pont Polychemical Co., Ltd.
*10: Hi-milan 1555 (trade name), ethylene-methacrylic acid copolymer ionomer resin obtained by neutralizing with zinc ion, manufactured by Mitsui Du Pont Polychemical Co., Ltd.

Flight performance (ball velocity, launch angle, carry (flight distance to the dropping point) and variability of flight direction from right to left were measured, and the results are shown in Table 4 as the average and the range. The test methods are as follows.

Test method (1) Numbers of occurring separation of the intermediate layer from the adhesive surface The numbers of occurring separation of the intermediate layer from the adhesive surface of the resulting two-layered core after 1 hour molded the intermediate layer were measured for every 30 samples.

(2) Eccentricity of the center after vulcanization

X-ray photographs of the resulting two-layered core from triaxial directions were taken, and eccentricity of the core was determined by calculating eccentricity of the core in each axial direction using the following formula to obtain the maximum value of the eccentricities in the triaxial directions.

$$\text{Eccentricity}=(t_{max}-t_{min})/2$$

wherein, $t_{max}$ represents the maximum thickness of the intermediate layer, and $t_{min}$ represents the minimum thickness of the intermediate layer.

(3) Flight performance

A No.1 wood club (a driver) was mounted to a swing robot manufactured by True Temper Co. and the resulting golf ball was hit at a head speed of 45 m/second for every 8 samples, ball velocity, launch angle, carry (flight distance to the dropping point) and variability of flight direction from right to left were measured, and the results are shown as the average and the range. The variability of flight direction from right to left is shown as 0 when the golf ball flied in the flight direction of the swing robot, as the distance glanced from the flight direction which is a negative number when the golf ball glanced from the direction to the left side, and as the distance glanced from the flight direction which is a positive number when the golf ball glanced from the direction to the right side.

TABLE 4

| Test item | Example No. 1 | 2 | 3 |
|---|---|---|---|
| Numbers of occurring separation of the intermediate layer from the adhesive surface (n = 30) | 0 | 0 | 0 |
| Eccentricity of the center after vulcanization (mm) | 0.25 | 0.21 | 0.17 |
| Variability of eccentricity | 0.06 to 0.51 | 0.05 to 0.48 | 0.07 to 0.42 |
| **Ball velocity (m/sec)** | | | |
| Average | 64.83 | 64.81 | 64.87 |
| Range | 64.70 to 64.92 (0.22) | 64.68 to 64.89 (0.21) | 64.74 to 64.93 (0.19) |
| **Launch angle (degree)** | | | |
| Average | 11.21 | 11.23 | 11.18 |
| Range | 10.95 to 11.38 (0.43) | 10.98 to 11.36 (0.38) | 10.92 to 11.32 (0.40) |
| **Carry (yard)** | | | |
| Average | 227.8 | 228.2 | 227.9 |
| Range | 226.5 to 229.1 (2.6) | 226.8 to 229.5 (2.7) | 226.9 to 229.1 (2.2) |
| **Variability of flight direction from right to left** | | | |
| Average | 0.1 | 0.4 | −0.3 |
| Range | −3.5 to 2.2 | −3.1 to 2.1 | −2.8 to 1.7 |

TABLE 5

| Test item | Comparative Example No. 1 | 2 | 3 |
|---|---|---|---|
| Numbers of occurring separation of the intermediate layer from the adhesive surface (n = 30) | 25 | 5 | 17 |
| Eccentricity of the center after vulcanization (mm) | 0.52 | 0.35 | 0.41 |
| Variability of eccentricity | 0.10 to 1.03 | 0.08 to 0.78 | 0.13 to 0.92 |
| **Ball velocity (m/sec)** | | | |
| Average | 64.81 | 64.85 | 64.88 |
| Range | 64.52 to 64.94 (0.22) | 64.67 to 64.93 (0.26) | 64.59 to 64.96 (0.32) |
| **Launch angle (degree)** | | | |
| Average | 11.17 | 11.22 | 11.19 |
| Range | 10.71 to 11.41 (0.70) | 10.85 to 11.35 (0.50) | 10.86 to 11.37 (0.51) |
| **Carry (yard)** | | | |
| Average | 226.7 | 226.9 | 226.8 |
| Range | 223.4 to 229.8 (6.4) | 224.8 to 229.1 (4.3) | 224.5 to 229.5 (5.0) |

TABLE 5-continued

| Test item | Comparative Example No. 1 | 2 | 3 |
|---|---|---|---|
| Variability of flight direction from right to left | | | |
| Average | 1.5 | −0.6 | 1.1 |
| Range | −7.1 to 8.5 | −4.5 to 3.7 | −6.8 to 7.6 |

As is apparent from the comparison of the physical properties of the golf balls of Examples 1 to 3 shown in Tables 4 with those of the golf balls of Comparative Examples 1 to 3 shown in Table 5, the golf balls of Examples 1 to 3 used a rubber component for an intermediate having a Mooney viscosity of 25 to 40 ML(1+4)100° C. and a content of a 1,2-vinyl bond of not more than 3.5% have no separation of the intermediate layer from the adhesive surface and have smaller eccentricity of the center in the two-layered core than the golf balls of Comparative Examples 1 to 3.

On the other hand, the golf balls of Comparative Examples 1 and 3 have large numbers of occurring separation of the intermediate layer from the adhesive surface and large eccentricity of the center in the two-layered core, because the rubber component for the intermediate layer has higher Mooney viscosity. The golf ball of Comparative Example 2 has large numbers of occurring separation of the intermediate layer from the adhesive surface and large eccentricity of the center in the two-layered core, because the rubber component has higher content of a 1,2-vinyl bond.

In addition, the golf balls of Examples 1 to 3 have narrower range of ball velocity, launch angle, carry (flight distance to the dropping point) and variability of flight direction from right to left, and thus have less unevenness in physical properties than the golf balls of Comparative Examples 1 to 3.

What is claimed is:

1. A multi-piece solid golf ball comprising a center, an intermediate layer formed on the center, and a cover covering the intermediate layer, wherein the intermediate layer is composed of one or more layers mainly containing a rubber component, the rubber component for the intermediate layer has a Mooney viscosity of 25 to 40 ML(1+4) 100° C. and contains a 1,2-vinyl bond content of not more than 3.5% based on a total rubber component.

2. A method for producing a multi-piece golf ball, comprising the steps of:

covering a vulcanized center composition with an intermediate layer composition, said center composition comprised of a base rubber having a high-cis polybutadiene rubber component containing a cis-1,4 bond content of not less than 40%, said intermediate layer composition comprised of a high-cis polybutadiene rubber component containing a cis-1,4 bond content of not less than 80%, a 1,2-vinyl bond content of not more than 3.5% based on a total rubber component and having a Mooney viscosity of 25 to 40ML(1+4)100° C.;

vulcanizing said intermediate layer composition on said center composition; and covering said vulcanized intermediate layer composition with a cover composition, said cover composition comprised of an ionomer resin component.

3. A multi-piece solid golf ball, comprising:

a center composition comprised of a base rubber, a crosslinking agent, and a metal salt of an unsaturated carboxylic acid;

an intermediate layer composition covering the center composition, said intermediate layer composition comprised of one or more layers of a high-cis polybutadiene rubber component containing a cis-1,4 bond content of not less than 80%, a 1,2-vinyl bond content of not more than 3.5% based on a total rubber component and having a Mooney viscosity of 25 to 40 ML(1+4)100° C.; and a cover composition, covering the intermediate composition, said cover composition comprised of an ionomer resin component or a mixture of ionomer resins, and optionally containing fillers and pigments.

* * * * *